US005714294A

United States Patent [19]

Maruta et al.

[11] Patent Number: 5,714,294

[45] Date of Patent: Feb. 3, 1998

[54] TONER FOR ELECTROPHOTOGRAPHY AND REINFORCING AGENT FOR SAID TONER

[75] Inventors: Masayuki Maruta, Hannan; Jun Shimizu, Naga-gun; Shinichi Sata; Yasuhiro Hidaka, both of Wakayama, all of Japan

[73] Assignee: Kao Corporation, Tokyo, Japan

[21] Appl. No.: 666,586

[22] PCT Filed: Dec. 19, 1994

[86] PCT No.: PCT/JP94/02142

§ 371 Date: Jun. 24, 1996

§ 102(e) Date: Jun. 24, 1996

[87] PCT Pub. No.: WO95/18401

PCT Pub. Date: Jul. 6, 1995

[30] Foreign Application Priority Data

Dec. 24, 1993 [JP] Japan ..... 5-326390

[51] Int. Cl.[6] ..... G03G 9/087

[52] U.S. Cl. ..... 430/110; 430/120

[58] Field of Search ..... 430/106, 109, 430/110, 111, 137, 138, 120

[56] References Cited

U.S. PATENT DOCUMENTS

| | | | |
|---|---|---|---|
| 3,900,529 | 8/1975 | Beer | 260/876 R |
| 3,941,898 | 3/1976 | Sadamatsu et al. | 427/18 |
| 4,386,147 | 5/1983 | Seimiya et al. | 430/99 |
| 4,486,524 | 12/1984 | Fujisaki et al. | 430/109 |
| 4,499,168 | 2/1985 | Mitsuhashi | 430/99 |
| 4,508,875 | 4/1985 | Kishida et al. | 525/308 |
| 4,973,538 | 11/1990 | Suzuki et al. | 430/111 |
| 4,985,469 | 1/1991 | Chip et al. | 521/64 |
| 5,206,299 | 4/1993 | Oshima et al. | 525/305 |
| 5,455,315 | 10/1995 | Paine et al. | 430/904 |

FOREIGN PATENT DOCUMENTS

| | | |
|---|---|---|
| 0421416 | 4/1991 | European Pat. Off. . |
| 51-23354 | 7/1976 | Japan . |
| 55-6895 | 3/1980 | Japan . |
| 63-32182 | 6/1988 | Japan . |

OTHER PUBLICATIONS

Patent Abstracts of Japan, vol. 95, No. 10, Nov. 30, 1995 (JP 07 181716A).

Patent Abstracts of Japan, vol. 95, No. 10, Nov. 30, 1995 (JP 07 181717A).

Patent Abstracts of Japan, vol. 95, No. 10, Nov. 30, 1995 (JP 07 181728A).

Patent Abstracts of Japan, vol. 95, No. 10, Nov. 30, 1995 (JP 07 181729A).

*Primary Examiner*—John Goodrow

*Attorney, Agent, or Firm*—Birch, Stewart, Kolasch & Birch, LLP

[57] ABSTRACT

A toner for electrophotography including a binder resin, a colorant, and a reinforcing agent, the toner being characterized in that the reinforcing agent is resin particles comprising a core layer coated with a vinyl polymer having a glass transition temperature of 50° C. or more, the core layer comprising an acrylic acid ester copolymer and/or a methacrylic acid ester copolymer having a glass transition temperature of 0° C. or less, or a diene copolymer having a glass transition temperature of 0° C. or less; a reinforcing agent for toner including the above resin particles; and in a method for forming fixed images by utilizing a nonmagnetic one-component developing method employing a developer device including a developer roller and a blade, the blade serving to regulate a thickness of a toner layer formed on the developer roller and to supply electric charges to the toner, the method for forming fixed images being characterized by the use of the above toner for electrophotography.

28 Claims, 1 Drawing Sheet

TONER FOR ELECTROPHOTOGRAPHY AND REINFORCING AGENT FOR SAID TONER

TECHNICAL FIELD

The present invention relates to a toner for electrophotography and electrostatic recording usable for visualizing a latent image formed on a photoconductive member, and a reinforcing agent used therefor. Also, the present invention relates to a method for forming fixed images which is carried out by using the above toner.

BACKGROUND ART

As disclosed in U.S. Patent Nos. 2,297,691 and 2,357,809 and other publications, conventional electrophotographic recording method comprises the steps of forming an electrostatic latent image by evenly charging a photoconductive insulating layer and subsequently exposing the layer to eliminate the charge on the exposed portion and visualizing the formed image by adhering colored charged fine powder known as a toner to the latent image (a developing process); transferring the obtained visible image to an image-receiving sheet such as a transfer paper (a transfer process); and permanently fixing the transferred image by heating, pressure application or other appropriate means of fixing (a fixing process). This electrophotography may further comprise, subsequent to the transferring of the visible image, a cleaning process comprising scraping off residual toners on the photoconductive member.

As indicated above, the toner must meet the requirements not only of the developing process, but also of the transfer process, the fixing process, and the cleaning process.

Examples of the typical fixing methods in the present invention include a heat-fixing method comprising heating and melting the toner and fixing the melted toner on a paper, etc.; and a pressure-fixing method comprising plastically deforming the toner by exerting pressure thereon and then fixing on a paper. From the viewpoints of simplicity of the apparatus and quality of the fixed images obtained upon fixing, a heat roller fixing method where a heat roller is used as a heating means of the toners is most frequently used.

In the heat-fixing method, the toners must be melted at a lowest temperature possible, and fixed to a recording medium, such as papers. In the recent years, from the viewpoint of energy conservation, there has been a high demand for a low-temperature fixing ability in the toner.

Proposed as methods for providing low-temperature fixing ability to the toners, Japanese Patent Examined Publication No. 55-6895 discloses that molecular weight distributions of styrenic copolymers, polyester resins, etc. are widened; and Japanese Patent Examined Publication No. 63-32182 discloses that the low-temperature fixing ability can be improved by having a molecular weight distribution with a double peak structure and shifting the molecular weight distribution to a lower molecular weight side. Similarly, as proposed in Japanese Patent Examined Publication No. 51-23354, a method of blending a crosslinked polymer and a low-molecular weight polymer is also frequently employed.

However, in these methods, since a large amount of low-molecular weight resins must be contained in the binder resins for toners in order to secure the low-temperature fixing ability, the toners are liable to be pulverized too finely. In other words, in the toner for two-component developer usable by mixing the toner with a carrier, the toner is broken by the impact stress from the carrier in the developer device, so that fine powders are increased, thereby leading to cause much background, or the fine powders are adhered to the carrier surface and thus taking away the charging ability of the carrier. On the other hand, even in the one-component developing method where no carriers are used, when a nonmagnetic one-component developing method is employed, for instance, pulverized fine powders produced by the stress between the charging blade and the developer roller are adhered to the charging blade and the developer roller, thereby failing to have stable image reproducibility.

Also, on the other hand, Japanese Patent Laid-Open No. 55-113054 proposes toners containing rubbery materials, such as diolefinic copolymers, thereby making it less liable to be pulverized, and thus have long durability. However, a considerably large amount of the diolefinic copolymers must be added to achieve the above purposes, and components having low glass transition temperatures are exposed to the toner surface, thereby causing such problems as making the storage stability of the toner poor.

As described above, achieving both the excellent low-temperature fixing ability and the stable image reproducibility has been extremely difficult, not being able to achieve a sufficient satisfactory level in the current circumstances.

DISCLOSURE OF THE INVENTION

As a result of intensive research in view of achieving the above problems, the present inventors have completed a toner having excellent stability with the passage of time and low fixing temperature, and have succeeded to stably and inexpensively provide high-quality copy images with appropriate image density and free from background in various development methods by the use of the above toner.

Specifically, the present invention is concerned with the following:

(1) A toner for electrophotography comprising a binder resin, a colorant, and a reinforcing agent, the toner being characterized in that the reinforcing agent is resin particles comprising a core layer coated with a vinyl polymer having a glass transition temperature of 50° C. or more, the core layer comprising an acrylic acid ester copolymer and/or a methacrylic acid ester copolymer having a glass transition temperature of 0° C. or less, or a diene copolymer having a glass transition temperature of 0° C. or less;

(2) The toner for electrophotography described in item (1) above, wherein the acrylic acid ester copolymer and/or the methacrylic acid ester copolymer is obtainable by using one or more monomers selected from the group consisting of ethyl acrylate, propyl acrylate, butyl acrylate, cyclohexyl acrylate, 2-ethylhexyl acrylate, octyl methacrylate, dodecyl methacrylate, and lauryl methacrylate;

(3) The toner for electrophotography described in item (1) above, wherein the diene copolymer is obtainable by using one or more monomers selected from the group consisting of 1,3-butadiene, isoprene, 2-chloro-1,3-butadiene, and 2-methyl-1,3-butadiene;

(4) The toner for electrophotography described in any one of items (1) to (3) above, wherein the core layer has inside the layer a core portion comprising a vinyl polymer;

(5) The toner for electrophotography described in item (4) above, wherein the vinyl polymer constituting the core portion is obtainable by using one or more monomers selected from the group consisting of styrene, vinyltoluene, α-methylstyrene, monochlorostyrene, 3,4-dichlorostyrene, and bromostyrene;

(6) The toner for electrophotography described in item (1) above, wherein the vinyl polymer having a glass transition temperature of 50° C. or more is obtainable by using one or more monomers selected from the group consisting of styrene, vinyltoluene, α-methylstyrene, monochlorostyrene, 3,4-dichlorostyrene, and bromostyrene;

(7) The toner for electrophotography described in item (4) or (5) above, wherein the resin particles comprise 0 to 40% by weight of the core portion, 30 to 90% by weight of the core layer, and 10 to 40% by weight of the coating layer;

(8) The toner for electrophotography described in any one of items (1) to (3) above, wherein the resin particles comprise 60 to 95% by weight of the core layer and 5 to 40% by weight of the coating layer;

(9) The toner for electrophotography described in any one of items (1) to (8) above, wherein the resin particles have a particle size of from 0.01 to 2.0 μm;

(10) The toner for electrophotography described in any one of items (1) to (9) above, wherein the amount of the resin particles added in the toner is from 0.01 to 10% by weight;

(11) The toner for electrophotography described in any one of items (1) to (10) above, wherein the toner for electrophotography is a nonmagnetic one-component toner usable in a developer device comprising a developer roller and a blade, the blade serving to regulate a thickness of a toner layer formed on the developer roller and to supply electric charges to the toner;

(12) A reinforcing agent for a toner which comprises resin particles comprising a core layer and a coating layer coated thereon comprising a vinyl polymer having a glass transition temperature of 50° C. or more, the core layer comprising an acrylic acid ester copolymer and/or a methacrylic acid ester copolymer having a glass transition temperature of 0° C. or less, or a diene copolymer having a glass transition temperature of 0° C. or less;

(13) The reinforcing agent for a toner described in item (12) above, wherein the acrylic acid ester copolymer and/or the methacrylic acid ester copolymer is obtainable by using one or more monomers selected from the group consisting of ethyl acrylate, propyl acrylate, butyl acrylate, cyclohexyl acrylate, 2-ethylhexyl acrylate, octyl methacrylate, dodecyl methacrylate, and lauryl methacrylate;

(14) The reinforcing agent for a toner described in item (12) above, wherein the diene copolymer is obtainable by using one or more monomers selected from the group consisting of 1,3-butadiene, isoprene, 2-chloro-1,3-butadiene, and 2-methyl-1,3-butadiene;

(15) The reinforcing agent for a toner described in any one of items (12) to (14) above, wherein the core layer has inside the layer a core portion comprising a vinyl polymer;

(16) The reinforcing agent for a toner described in item (15) above, wherein the vinyl polymer constituting the core portion is obtainable by using one or more monomers selected from the group consisting of styrene, vinyltoluene, α-methylstyrene, monochlorostyrene, 3,4-dichlorostyrene, and bromostyrene;

(17) The reinforcing agent for a toner described in item (12) above, wherein the vinyl polymer having a glass transition temperature of 50° C. or more is obtainable by using one or more monomers selected from the group consisting of styrene, vinyltoluene, α-methylstyrene, monochlorostyrene, 3,4-dichlorostyrene, and bromostyrene;

(18) The reinforcing agent for a toner described in item (15) or (16) above, wherein the resin particles comprise 0 to 40% by weight of the core portion, 30 to 90% by weight of the core layer, and 10 to 40% by weight of the coating layer;

(19) The reinforcing agent for a toner described in any one of items (12) to (14) above, wherein the resin particles comprise 60 to 95% by weight of the core layer and 5 to 40% by weight of the coating layer;

(20) The reinforcing agent for a toner described in any one of items (12) to (19) above, wherein the resin particles have a particle size of from 0.01 to 2.0 μm; and

(21) In a method for forming fixed images by utilizing a nonmagnetic one-component developing method employing a developer device comprising a developer roller and a blade, the blade serving to regulate a thickness of a toner layer formed on the developer roller and to supply electric charges to the toner, the method for forming fixed images being characterized by the use of the toner for electrophotography described in any one of items (1) to (10) above.

BEST MODE FOR CARRYING OUT THE INVENTION

Figure 1:
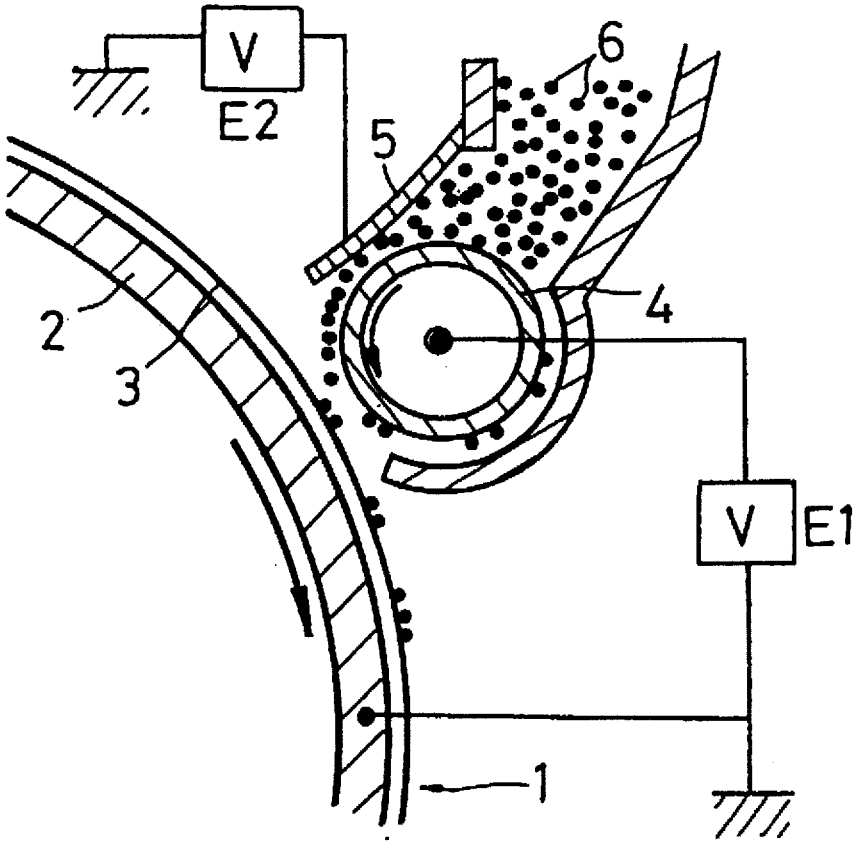
FIG. 1 is a schematic view showing one example of developer device utilized by a nonmagnetic one-component development employed in a method for forming fixed images of the present invention. Here, 1 is a photoconductor, 2 a conductive supporter, 3 a photoconductive member, 4 a developer roller, 5 a developing blade, and 6 a toner.

The reinforcing agent of the present invention is characterized in that it is resin particles comprising a core layer coated with a vinyl polymer having a glass transition temperature of 50° C. or more, the core layer comprising an acrylic acid ester copolymer and/or a methacrylic acid ester copolymer having a glass transition temperature of 0° C. or less, or a diene copolymer having a glass transition temperature of 0° C. or less. And the toner for electrophotography of the present invention is characterized in that it contains the above reinforcing agent.

First, the reinforcing agent of the present invention will be explained.

The resin particles, which are usable as the reinforcing agent of the present invention, are obtainable by the steps of previously carrying out emulsification polymerization of an acrylic acid ester copolymer and/or a methacrylic acid ester copolymer having a glass transition temperature of 0° C. or less, or a diene copolymer having a glass transition temperature of 0° C. or less, and then carrying out seed emulsification polymerization so as to coat the resulting copolymer with a vinyl polymer having a glass transition temperature of 50° C. or more.

Also, in order to improve the stability of the emulsification polymerization upon production of the above resin particles, prior to the polymerization of the acrylic acid ester copolymer and/or the methacrylic acid ester copolymer having a glass transition temperature of 0° C. or less constituting the core layer, aromatic vinyl copolymers using such monomers as styrene, vinyltoluene, α-methylstyrene, monochlorostyrene, 3,4-dichlorostyrene, and bromostyrene, may be polymerized, thereby forming the core portion comprising rubbery particles. Here, styrene is preferably used.

In other words, the resin particles which are usable as the reinforcing agent of the present invention may be constituted by the core portion, the rubbery layer (hereinafter referred to as "the core layer"), and the coating layer.

In the polymerization of the core portion, the vinyl monomers may be copolymerized with non-aromatic monomers, including alkyl acrylates, such as ethyl acrylate and butyl acrylate; alkyl methacrylates, such as methyl methacrylate and butyl methacrylate; vinyl cyanides, such as acrylonitrile and methacrylonitrile; and vinylidene cyanides. However, when the added amounts of the non-aromatic monomers are too large, the rubbery portion and the core portion are mixed, thereby impairing the rubber elasticity of the overall particle. Therefore, the non-aromatic monomers have a content of 50% by weight or less, preferably 20% by weight or less, of the entire monomers constituting the core portion. Also, the core portion may be further crosslinked by a crosslinking polymer. The amount of the crosslinking polymer usable in the core portion is normally 30% by weight or less, preferably 15% by weight or less, of the core portion.

Examples of the usable crosslinking polymers mentioned above include monomers having two or more polymerizable ethylenic unsaturated bonds in the molecule, including aromatic vinyl monomers, such as divinylbenzene; and alkane polyol poly(meth)acrylates, such as ethylene glycol di(meth) acrylate, butylene glycol di(meth)acrylate, hexane diol di(meth)acrylate, oligoethylene glycol di(meth)acrylate, trimethylolpropane di(meth)acrylate, and trimethylolpropane tri(meth)acrylate.

Examples of monomers (having a glass transition temperature of 0° C. or less) usable for obtaining the acrylic acid ester copolymer and/or the methacrylic acid ester copolymer having a glass transition temperature of 0° C. or less constituting the core layer include alkyl acrylates, such as ethyl acrylate, propyl acrylate, butyl acrylate, cyclohexyl acrylate, and 2-ethylhexyl acrylate; and alkyl methacrylates, such as octyl methacrylate, dodecyl methacrylate, and lauryl methacrylate. The number of carbon atoms of these alkyl moleties is normally from 1 to 20. Here, 2-ethylhexyl acrylate is preferably used.

Examples of monomers (having a glass transition temperature of 0° C. or less) usable for obtaining the diene copolymer having a glass transition temperature of 0° C. or less include monomers generally usable in the production of latex, such as 1,3-butadiene, isoprene, 2-chloro-1,3-butadiene, and 2-methyl-1,3-butadiene. 1,3-Butadiene and isoprene are preferably used.

In the polymerization of the core layer, the alkyl acrylates, the alkyl methacrylates, and the diene monomers mentioned above may be copolymerized with other vinyl monomers. Examples of other monomers copolymerizable therewith include aromatic vinyl copolymers of such monomers as styrene, vinyltoluene, α-methylstyrene, monochlorostyrene, 3,4-dichlorostyrene, and bromostyrene; methacrylic acid esters, such as methyl methacrylate and butyl methacrylate; acrylic acid esters, such as butyl acrylate and 2-ethylhexyl acrylate. The amount of the above monomers is determined so as to give the resulting polymer obtained by copolymerization with a glass transition temperature of 0° C. or less.

Also, the core layer may be also crosslinked by a crosslinking polymer. Examples of the crosslinking polymers include monomers having two or more polymerizable ethylenic unsaturated bonds in the molecule, including aromatic vinyl monomers, such as divinylbenzene; and alkane polyol poly(meth)acrylates, such as ethylene glycol di(meth) acrylate, butylene glycol di(meth)acrylate, hexane diol di(meth)acrylate, oligoethylene glycol di(meth)acrylate, trimethylolpropane di(meth)acrylate, and trimethylolpropane tri(meth)acrylate. The amount of the crosslinking polymer is normally 0.01 to 5% by weight, preferably 0.1 to 2% by weight, of the entire monomers constituting the core layer.

On the other hand, examples of the vinyl polymers having a glass transition temperature of 50° C. or more constituting the coating layer for coating the core layer include aromatic vinyl copolymers of such monomers as styrene, vinyltoluene, α-methylstyrene, monochlorostyrene, 3,4-dichlorostyrene, and bromostyrene may be conveniently used, with a preference given to styrene. In the polymerization of the coating layer, the vinyl monomers may be copolymerized with non-aromatic monomers, such as alkyl acrylates, such as ethyl acrylate and butyl acrylate; alkyl methacrylates, such as methyl methacrylate and butyl methacrylate; vinyl cyanides, such as acrylonitrile and methacrylonitrile; and vinylidene cyanides. However, in the case where the core layer comprises an acrylic acid ester copolymer and/or a methacrylic acid ester copolymer, when the added amounts are too large, the rubbery portion and the coating layer are mixed, so that a coating effect achieved by the coating layer cannot be obtained, thereby impairing the storageablity of the resulting toners when the particles are exposed on the pulverized interface of the resulting toners. Therefore, the non-aromatic monomers have a content of 50% by weight or less, preferably 30% by weight or less of the entire monomers constituting the coating layer.

Also, the coating layer may be further crosslinked by a crosslinking polymer. The amount of the crosslinking polymer usable in the coating layer is normally 30% by weight or less, preferably from 5 to 15% by weight, of the coating layer. Examples of the crosslinking monomers mentioned above may be the same crosslinking monomers as the compounds usable for the production of the core layer, such as divinylbenzene.

In the case where the core layer comprises an acrylic acid ester copolymer and/or a methacrylic acid ester copolymer, the resin particles, which are usable as the reinforcing agent of the present invention, have such a layer structure that the resin particles comprise 0 to 40% by weight of the core portion, 30 to 90% by weight of the core layer, and 10 to 40% by weight of the coating layer, and they preferably comprise 0 to 30% by weight of the core portion, 40 to 80% by weight of the core layer, and 15 to 25% by weight of the coating layer.

In the case where the core layer comprises a diene copolymer, the resin particles, which are usable as the reinforcing agent of the present invention, have such a layer structure that the resin particles comprise 60 to 95% by weight of the core layer and 5 to 40% by weight of the coating layer, and they preferably comprise 75 to 90% by weight of the core layer and 10 to 25% by weight of the coating layer.

The resin particles, which are usable as the reinforcing agent of the present invention, are obtainable by carrying out emulsification polymerization of the above monomers using a water-soluble polymerization initiator in the presence of an emulsifier. Alternatively, the resin particles may be obtainable by carrying out a soap-free emulsification polymerization method where an emulsifier is not employed.

As for emulsifiers and polymerization initiators usable in the emulsification polymerization of the resin particles, which are usable as the reinforcing agent of the present invention, all of the conventionally known ones can be used. Typical examples of the emulsifiers include fatty acid salts, representatively including sodium and potassium laureates, sodium and potassium myristates, sodium and potassium palmitates, sodium and potassium stearates, and sodium and potassium oleates; N-acylamino acid salts, representatively including N-acyl-N-methylglycine sodium salt and potassium salt, N-acyl-N-methyl-β-alanine sodium salt and potassium salt, and sodium salt and potassium salt of N-acylglutamic acid; alkyl ether carboxylates, representatively including sodium and potassium polyoxyethylene alkyl ether acetates; alkylbenzenesulfonates, such as sodium alkylbenzenesulfonates; alkylnaphthalenesulfonates; dialkylsulfosuccinic acid ester salts; alkyl sulfoacetates; α-olefinsulfonates; sulfuric acid ester salts, such as higher alcohol sulfuric acid ester salts, secondary higher alcohol sulfuric acid ester salts, alkyl ether sulfates, secondary higher alcohol ethoxysulfate, and polyoxyethylene alkylphenyl ether sulfates; phosphoric acid ester salts, such as alkyl ether phosphosphoric acid ester salts and alkyl phosphoric acid ester salts (hereinabove, anionic surfactants); aliphatic quaternary ammonium salts, such as alkyl trimethyl ammonium chloride, alkyl trimethyl ammonium bromide, and dialkyl dimethyl ammonium chloride; benzalkonium salts, such as alkyl dimethyl benzyl ammonium chloride and alkyl dimethyl benzyl ammonium bromide; pyridinium salts, such as cetyl pyridinium chloride and cetyl pyridinium bromide; imidazolinium salts (hereinabove, cationic surfactants); amphoteric surfactants having such structures as carboxybetaine, sulfobetaine, aminocarboxylate, and imidazolinium betaine in the molecule; nonionic surfactants, such as polyoxyethylene alkyl ethers, polyoxyethylene secondary alcohol ethers, polyoxyethylene alkyl phenyl ethers, polyoxyethylene sterol ethers, polyoxyethylene lanolin derivatives, polyoxyethylene polyoxypropylene alkyl ethers, polyoxyethylene glycerol fatty acid esters, polyoxyethylene sorbitan fatty acid esters, polyoxyethylene sorbitol fatty acid esters, polyethylene glycol fatty acid esters, fatty acid monoglycerides, polyglycerol fatty acid esters, sorbitan fatty acid esters, propylene glycol fatty acid esters, fatty acid alkanolamides, polyoxyethylene fatty acid amides, polyoxyethylene alkyl amines, and alkyl amine oxides; and fluorine-based surfactants. The amount of the emulsifiers is 0 to 10% by weight, preferably 0 to 3% by weight, to the monomers.

In addition, examples of the polymerization initiators include persulfates, such as sodium persulfate, potassium persulfate, and ammonium persulfate; organic peroxides, such as cumene hydroperoxide, benzoyl peroxide, isopropylbenzene peroxide, and dicumyl peroxide; neutralized salts of azo polymerization initiators containing carboxylic acid in the molecule, such as sodium 4,4'-azobis(4-cyanovalerate), potassium 4,4'-azobis(4-cyanovalerate), and ammonium 4,4'-azobis(4-cyanovalerate); azoamidine compounds, such as 2,2'-azobis(2-methyl-N-phenylpropionamidine), 2,2'-azobis[N-(4-chlorophenyl)-2-methylpropionamidine], 2,2'-azobis[N-(4-hydroxyphenyl)-2-methylpropionamidine], 2,2'-azobis[N-(4-aminophenyl)-2-methylpropionamidine], 2,2'-azobis[2-methyl-N-(phenylmethyl)propionamidine], 2,2'-azobis(2-methyl-N-2-propenylpropionamidine), 2,2'-azobis(2-methylpropionamidine), 2,2'-azobis[N-(2-hydroxyethyl)-2-methylpropionamidine], and hydrochlorides, methanesulfonates, or p-toluenesulfonates thereof; cyclic azoamidine compounds, 2,2'-azobis[2-(5-methyl-2-imidazolin-2-yl)propane], 2,2'-azobis[2-(2-imidazolin-2-yl)propane], 2,2'-azobis[2-(4,5,6,7-tetrahydro-1H-1,3-diazepin-2-yl]propane], 2,2-azobis[2-(3,4,5,6-tetrahydropyrimidin-2-yl)propane], 2,2-azobis[2-(5-hydroxy-3,4,5,6-tetrahydropyrimidin-2-yl)propane], and 2,2'-azobis[2-{1-(2-hydroxyethyl)-2-imidazolin-2-yl}propane], and hydrochlorides, methanesulfonates, or p-toluenesulfonates thereof. The amount of the polymerization initiator is 0.01 to 5% by weight, preferably 0.1 to 2% by weight, to the monomers.

The resin particles, which are usable as the reinforcing agent of the present invention, are obtainable in the form of powders by the steps of carrying out polymerization, isolating the resulting polymer by freezing and thawing or salting out, and then subjecting the isolated polymer to a centrifugal dehydration or drying. Alternatively, the resin particles are formed into powders by using spray dryers and freeze dryers. In addition, by adding the step of removing water-soluble by-product remaining in the polymeric liquid mixture using an ion exchange resin and an ultra-filtration membrane prior to drying step, the disadvantageous effects to the toner owning to these impurities can be reduced.

The resin particles, which are usable as the reinforcing agent of the present invention, have a particle size of from 0.01 to 2.0 μm, preferably from 0.1 to 0.7 μm, more preferably from 0.2 to 0.5 μm. When the particle size of the resin particles is too small, sufficient reinforcing effects cannot be performed upon the addition of the resin particles to the toner. On the contrary, when the particle size is too large, the particles become more liable to be detached from the toners. The particle size of the resin particles can be measured by making observation using a scanning electron microscope or measuring by a dynamic light scattering method. Also, it is important that the resin particles are not aggregated in the toner but dispersed in a state of primary particles in order to have good exhibition of the reinforcing effects.

The resin particles, which are usable as the reinforcing agent of the present invention, are added in an amount of from 0.01 to 10% by weight, preferably from 0.1 to 5% by weight, to the toner. When the amount added is too small, sufficient reinforcing effects cannot be performed upon the addition of the resin particles. On the contrary, when the amount added is too large, the pulverizability of the toner becomes poor upon the toner production, thereby resulting in poor productivity. Therefore, the amount of the resin particles added should be preferably determined by carefully considering the properties of the binder resin.

Examples of the binder resins usable for the toners of the present invention include homopolymers or copolymers of styrenes, such as styrene, chlorostyrene, and α-methylstyrene; monoolefins, such as ethylene, propylene, butylene, and isobutylene; vinyl esters, such as vinyl acetate, vinyl propionate, vinyl benzoate, and vinyl butyrate; α-methylenic, aliphatic monocarboxylic acid esters, such as methyl acrylate, ethyl acrylate, butyl acrylate, octyl acrylate, dodecyl acrylate, phenyl acrylate, methyl methacrylate, ethyl methacrylate, butyl methacrylate, and dodecyl methacrylate; vinyl ethers, such as vinyl methyl ether, vinyl ethyl ether, and vinyl butyl ether; vinyl ketones, such as vinyl methyl ketone, vinyl hexyl ketone, and vinyl isopropenyl ketone; and polyester resins obtainable by carrying out condensation polymerization reactions between one or more acid monomers and one or more alcohol monomers, the acid monomers being one or more monomers selected from the group consisting of phthalic acid, isophthalic acid, terephthalic acid, fumaric acid, maleic acid, n-dodecenylsuccinic acid, isododecenylsuccinic acid, isooctylsuccinic acid, n-octylsuccinic acid, n-butylsuccinic acid, trimellitic acid, pyromellitic acid, acid anhydrides thereof, lower alkyl esters thereof, and other acid components, and the alcohol monomers being one or more monomers selected from the group consisting of polyoxypropylene(2,2)-2,2-bis(4-hydroxyphenyl)propane, polyoxyethylene(2)-2,2-bis(4-hydroxyphenyl)propane, polyoxypropylene(6)-2,2-bis(4-hydroxyphenyl)propane, polyoxypropylene(16)-2,2-bis(4-hydroxyphenyl)propane, ethylene glycol, propylene glycol, glycerol, pentaerythritol, trimethylolpropane, hydrogenated bisphenol A, sorbitol, and etherified polyhydroxy compounds thereof, namely polyoxyethylene(10)sorbitol, polyoxyethylene(3)glycerol, polyoxyethylene(4) pentaerythritol, and other alcohol monomers. In addition, natural and synthetic waxes, polyamides, epoxy resins, polycarbonates, polyurethanes, silicone resins, fluororesins, and petroleum resins may be further used. Among them, the polyester resins are preferably used.

In addition, examples of the colorants usable in the toners include carbon blacks; acetoacetic arylamide-based monoazo yellow pigments, such as C.I. Pigment Yellow 1, C.I. Pigment Yellow 3, C.I. Pigment Yellow 74, C.I. Pigment Yellow 97, and C.I. Pigment Yellow 98; acetoacetic arylamide-based bisazo yellow pigments, such as C.I. Pigment Yellow 12, C.I. Pigment Yellow 13, C.I. Pigment Yellow 14, and C.I Pigment Yellow 17; yellow dyes, such as C.I. Solvent Yellow 19, C.I. Solvent Yellow 77, C.I. Solvent Yellow 79, and C.I. Disperse Yellow 164; red or crimson pigments, such as C.I. Pigment Red 48, C.I. Pigment Red 49:1, C.I. Pigment Red 53:1, C.I. Pigment Red 57, C.I. Pigment Red 57:1, C.I. Pigment Red 81, C.I. Pigment Red 122, and C.I. Pigment Red 5; red dyes, such as C.I. Solvent Red 49, C.I. Solvent Red 52, C.I Solvent Red 58, and C.I. Solvent Red 8; blue pigments and dyes of copper phthalocyanine, such as C.I. Pigment Blue 15:3, and derivatives thereof; green pigments, such as C.I. Pigment Green 7 and C.I. Pigment Green 36(Phthalocyanine Green). These pigments or dyes may be used alone or in combination of two or more kinds. These colorants are preferably added in an amount of from 2 to 15 parts by weight, based on 100 parts by weight of the binder resin.

Further, the charge control agents usable in toners include those usable for negatively chargeable toners and those usable for positively chargeable toners. Examples of the charge control agents usable for negatively chargeable toners may include as chromium complexes of azo dyes; iron complexes of azo dyes; cobalt complexes of azo dyes; chromium, zinc, aluminum or boron complexes of salicylic acid or derivatives thereof, or salt compounds thereof; chromium, zinc, aluminum or boron complexes of naphthalic acid or derivatives thereof, or salt compounds thereof; chromium, zinc, aluminum or boron complexes of benzylic acid or derivatives thereof, or salt compounds thereof; surfactants such as long-chain-alkylcarboxylates and long-chain-alkylsulfonates. Examples of those usable for positively chargeable toners may include nigrosine dyes and derivatives thereof; triphenylmethane derivatives; derivatives of such salts as quaternary ammonium salts, quaternary phosphonium salts, quaternary pyridinium salts, guanidine salts and amidine salts. The amount of the charge control agent is preferably 0.01 to 5 parts by weight, based on 100 parts by weight of the binder resin.

Also, in the toner of the present invention, conductivity adjusting agents, metal oxides such as tin oxide, silica, alumina, zirconia, titania, and zinc oxide, antioxidants, and releasing agents may be added. In addition, in cases of magnetic toners, magnetic materials, such as ferrite, etc. may be used.

Further, various additives may be also added for the purposes of adjusting fluidity to prevent the formation of thin filming of toners on a photoconductor, or improving cleanability of the residual toner on the photoconductor. Examples of these additives include inorganic oxides such as silica, alumina, titania, zirconia, tin oxide, and zinc oxide; resin fine particles obtained by homopolymerization or copolymerization of acrylic acid esters, methacrylic acid esters and styrene; fluororesin fine particles; silicone resin fine particles; higher fatty acids, such as stearic acid, and metal salts thereof; carbon black; lead fluoride; silicon carbide; and boron nitride.

The amount of the various additives mentioned above is preferably 0 to 10 parts by weight, based on 100 parts by weight of the binder resin.

As for the production methods for the toners of the present invention, conventionally known production methods, such as kneading and pulverization method, spray-drying method, and polymerization method can be employed.

The toners of the present invention may be either one-component or two-component toners, and they may be nonmagnetic toners or magnetic toners. For instance, in two-component toners, the durability against shocking stress given by the carriers in the developer devices is improved, and in one-component nonmagnetic toners, the durability against frictional stress given by charging members, such as charging blades, is improved.

The method for forming fixed images will be explained below employing nonmagnetic one-component developing method as an example of such methods. Specifically, one embodiment of the method for forming fixed images of the present invention is such a method for forming fixed images employing a nonmagnetic one-component developing method using a developer roller and a blade, the blade serving to regulate a thickness of a toner layer formed on the developer roller and to supply electric charges to the toner.

Here, the nonmagnetic one-component developing method refers to a developing method, for instance, comprising visualizing the electrostatic latent image on the surface of the electrostatic latent image-forming member with the toners by using a developer device at least comprising a developer roller arranged in contact or close to an electrostatic latent image-forming member and a blade, the blade serving to regulate a thickness of a toner layer formed on the developer roller and to supply electric charges to the toner. FIG. 1 is a schematic view showing one example of a developer device utilizing a nonmagnetic one-component developing method employed in the method for forming fixed images of the present invention, but the present invention is not restricted thereto.

1 is a photoconductor which normally comprises a conductive supporter 2 and a photoconductive member 3, and any of the known organic photoconductors (OPC) and inorganic photoconductors can be used. 4 is a developer roller, which is a carrier for a toner. Examples of the developer rollers include cylinders made of conductive nonmagnetic metals; and cylinders made of conductive resins prepared by dispersing conductive fine particles in resins. 5 is a developing blade which is provided for adjusting the chargeability, while regulating the thickness of the layer of toners, the developing blade being arranged opposite to the developer roller. Plates having a thickness of 0.1 to 2.0 mm made of stainless steel, copper, aluminum, etc. are generally used therefor.

Also, dielectric or semiconductive materials which are suitable for charging the toner to a desired polarity can be used. The nip pressure of the developing blade 5 onto the developer roller 4 is usually 0.1 to 3.0 gf/mm, preferably 0.3 to 2.5 gf/mm, from the viewpoints of effectively providing a thin layer formation and uniform chargeability.

The development is carried out by providing a gap between the photoconductor 1 and the developer roller 4 of not less than the thickness of the toner layer, in order to prevent background. A contact type development can be also carried out. Also, the photoconductor 1 and the developer roller 4 rotate in the same direction at the gap portion mentioned above. In this case, in order to improve the developing efficiency, as shown in FIG. 1, it is preferable to apply a direct current voltage with a power source E1 at absolute values of 50 V to 2000 V, preferably 100 V to 1000 V, between the developer roller 4 and the photoconductor 1. Further, if necessary, in order to improve the chargeability of the toner, to reduce background and improve the resolution of the printed images, an alternating voltage (for instance, an alternating current voltage) may be superimposed thereto.

By providing conductivity to the developing blade 5, excessive charging of the toner can be prevented, thereby making it possible to prevent electrostatic agglomeration or solidification of the toners. Also, in order to improve the developing efficiency and obtain stable chargeability, it is also possible to apply a given voltage to the developing blade 5 at absolute values in the range from 100 V to 800 V with a power source E2 as shown in FIG. 1.

The developing methods in the present invention are not limited to the nonmagnetic one-component development mentioned above, and various known developing methods can be employed.

The method for forming fixed images of the present invention comprises a step of forming an electrostatic latent image on an electrostatic latent image forming member, a developing step of adhering a toner to the electrostatic latent image, using such methods as the nonmagnetic one-component developing method mentioned above, to form a toner image; and a step of transferring and fixing the toner image to a recording medium. In the fixing process in the present invention, since those having a low molecular weight can be used as binder resins in the toner, the fixing temperature can be lowered as compared to conventional toners.

Examples and Comparative Examples of the present invention will be described hereinbelow, without intending to limit the present invention to these examples. Incidentally, unless specified otherwise, the term "parts" always means parts by weight.

PRODUCTION EXAMPLE 1

To a five-liter separable flask equipped with a reflux condenser, a nitrogen inlet tube, and a dropping funnel, 2000 g of ion-exchanged water and 6.4 g of a 50%-aqueous solution of sodium dioctyl sulfosuccinate were placed, and the contents were heated to 80° C. while introducing nitrogen. Next, 30 g of methyl methacrylate and 80 g of 2%-ammonium persulfate aqueous solution were added to the above mixture to initiate polymerization. Further, after 10 minutes from adding the ammonium persulfate, monomers comprising:

| | |
|---|---|
| Styrene | 304 g; |
| Divinylbenzene | 36 g; and |
| Methyl methacrylate | 30 g |

were added dropwise to the above mixture over a period of one hour. Thereafter, the resulting mixture was matured by keeping at 80° C. for one hour. Next, an additional 80 of 2%-ammonium persulfate aqueous solution was added to the above, and subsequently, monomers comprising:

| | |
|---|---|
| 2-Ethylhexyl acrylate | 1122 g; |
| Divinylbenzene | 18 g; and |
| Methyl methacrylate | 60 g |

were added dropwise to the above mixture over a period of three hours. Thereafter, the resulting mixture was matured by keeping at 80° C. for one hour. Next, an additional 50 g of 2%-ammonium persulfate aqueous solution was added to the above, and subsequently, monomers comprising:

| | |
|---|---|
| Styrene | 240 g; |
| Acrylonitrile | 100 g; and |
| Divinylbenzene | 60 g |

were added dropwise to the above mixture over a period of one hour. Thereafter, the resulting mixture was matured by keeping at 80° C. for one hour. After the completion of the reaction, the mixture was cooled to room temperature, and then filtered with a 400-mesh wire gauze. Thereafter, the product was obtained using an ion-exchanged resin, and then the resulting product was concentrated with an ultrafiltration membrane. The obtained concentrate was dried by keeping it standing in an oven at 50° C. for one night and day. In addition, the dried resin was disintegrated using a Henschel mixer, to give resin particles "a" according to the present invention. As a result of observation of the resulting resin particles using a scanning electron microscope, their particle sizes were found to be about 300 nm. When the glass transition temperature of the resulting resin particles was measured according to the DSC method as detailed below, the transition temperatures of −65° C. and 103° C. were observed. Measurement device: "DSC5000" manufactured by Seiko Instruments, Inc.

Measurement procedures:

(1) Filling a cell with a sample of about 15 mg.
(2) Raising the temperature from 20° C. to 200° C. at a rate of 10° C./min.
(3) Rapidly cooling from 200° C .to −10° C. (at a rate of 100° C./min).
(4) Keeping at −10° C. for three minutes.
(5) Raising the temperature from −10° C. to 25° C. at an increment of 60° C./min.
(6) Raising the temperature from 25° C. to 120° C. at a rate of 10° C./min, to initiate measurement.
(7) Determining, as the glass transition temperature, the temperature of an intersection of the tangential line of the heat absorption curve obtained in (6) and the baseline.

Comparative Production Example 1

To an apparatus similar to that of Production Example 1, 2000 g of ion-exchanged water and 6.4 g of a 50%-aqueous solution of sodium dioctyl sulfosuccinate were placed, and the contents were heated to 80° C. while introducing nitrogen. Next, after 10 minutes from adding 30 g of methyl methacrylate and ammonium persulfate, monomers comprising:

| | |
|---|---|
| Styrene | 304 g; |
| Divinylbenzene | 36 g; and |
| Methyl methacrylate | 30 g |

were added dropwise to the above mixture over a period of one hour. Thereafter, the resulting mixture was matured by keeping at 80° C. for one hour. Next, an additional 80 g of 2%-ammonium persulfate aqueous solution was added to the above, and subsequently, monomers comprising:

| | |
|---|---|
| 2-Ethylhexyl acrylate | 1496 g; |
| Divinylbenzene | 24 g; and |
| Methyl methacrylate | 80 g |

were added dropwise to the above mixture over a period of four hours. Thereafter, the resulting mixture was matured by keeping at 80° C. for one hour. After the completion of the reaction, the resulting mixture was subjected to filtration, purification, and drying in the same manner as in Production Example 1. However, even when a Henschel mixer was employed, the resulting product was not able to be disintegrated, merely obtaining a rubbery block.

Comparative Production Example 2

To an apparatus similar to that of Production Example 1, 2000 g of ion-exchanged water and 6.4 g of a 50%-aqueous solution of sodium dioctyl sulfosuccinate were placed, and the contents were heated to 80° C. while introducing nitrogen. Next, 30 g of methyl methacrylate and 80 g of 2%-ammonium persulfate aqueous solution were added to the above mixture to initiate polymerization. Further, after 10 minutes from adding the ammonium persulfate, monomers comprising:

| | |
|---|---|
| Styrene | 304 g; |
| Divinylbenzene | 36 g; and |
| Methyl methacrylate | 30 g |

were added dropwise to the above mixture over a period of one hour. Thereafter, the resulting mixture was matured by keeping at 80° C. for one hour. Next, an additional 80 g of 2%-ammonium persulfate aqueous solution was added to the above, and subsequently, monomers comprising:

| | |
|---|---|
| t-Butyl acrylate | 1122 g; |
| Divinylbenzene | 18 g; and |
| Methyl methacrylate | 60 g |

were added dropwise to the above mixture over a period of three hours. Thereafter, the resulting mixture was matured by keeping at 80° C. for one hour. Next, an additional 50 g of 2%-ammonium persulfate aqueous solution was added to the above, and subsequently, monomers comprising:

| | |
|---|---|
| Styrene | 240 g; |
| Acrylonitrile | 100 g; and |
| Divinylbenzene | 60 g |

were added dropwise to the above mixture over a period of one hour. Thereafter, the resulting mixture was matured by keeping at 80° C. for one hour. After the completion of the reaction, the same procedures as in Production Example 1 were carried out, to give resin particles "b." The particle size was measured in the same manner as in Production Example 1, and it was found to be about 290 nm. The glass transition temperature of the resulting resin particles was measured in the same manner as in Production Example 1, and as a result, a transition temperature was observed only at 104° C.

PRODUCTION EXAMPLE 2

In a five-liter autoclave which was replaced with nitrogen, the following components:

| | |
|---|---|
| Ion-exchanged water | 100 parts |
| Sodium alkylbenzenesulfonate | 0.5 parts |
| Potassium persulfate | 0.5 parts |
| 1,3-Butadiene | 85 parts |

were placed, and the polymerization reaction was carried out at 70° C. over a period of 15 hours while stirring the components. Further, the components comprising:

| | |
|---|---|
| Potassium persulfate | 0.1 parts |
| Styrene | 9 parts |
| Acrylonitrile | 3.75 parts |
| Divinylbenzene | 2.25 parts |

were added to the above, and the reaction was continued for another two hours. Thereafter, pH was adjusted to 7.5 using sodium hydroxide. Next, steam was blown into the autoclave to remove the unreacted monomers, and subsequently, the resulting product was subjected to drying using a freeze dryer, to give resin particles "c" according to the present invention. As a result of an observation by a scanning electron microscope, the particle size was about 0.3 μm. The glass transition temperature of the resulting resin particles was measured by the DSC method, and as a result, transition temperatures were observed at −78° C. and 103° C.

Comparative Production Example 3

In a five-liter autoclave which was replaced with nitrogen, the following components:

| | |
|---|---|
| Ion-exchanged water | 100 parts |
| Sodium alkylbenzenesulfonate | 0.5 parts |
| Potassium persulfate | 0.5 parts |
| 1,3-Butadiene | 100 parts |

were placed, and the polymerization reaction was carried out at 70° C. over a period of 15 hours while stirring the components. Thereafter, pH was adjusted to 7.5 using sodium hydroxide. Next, steam was blown into the autoclave to remove the unreacted monomers, and subsequently, the resulting product was subjected to drying using a freeze dryer. Although an observation was made by a scanning electron microscope, the particles are aggregated, and a definite particle size was not able to be obtained. The resin particles are referred to as "d." The glass transition temperature of the resulting resin particles was measured by the DSC method, and as a result, a transition temperature was observed at −78° C.

Example 1

| | |
|---|---|
| Polyester resin (1) (softening point: 115° C.) comprising as its main components terephthalic acid, n-dodecenylsuccinic acid, trimellitic acid, bisphenol A ethylene oxide adduct, and bisphenol A propylene oxide adduct | 100 parts |
| Carbon black ("MOGAL L" (manufactured by Cabot Corporation)) | 6 parts |
| Iron azo complex ("T-77," manufactured by Hodogaya Chemical Co., Ltd.) | 3 parts |
| Polypropylene wax ("VISCOL 660P" (manufactured by Sanyo Chemical Industries, Ltd.)) | 2 parts |

-continued

| | |
|---|---|
| Resin particles "a" | 3 parts |

were previously blended, and the mixture was melt-blended, pulverized by a jet mill, and classified, to give colored particles having an average particle size of 8.2 μm. To 100 parts of the colored particles, 0.4 parts of "AEROZIL R-972" (manufactured by Nippon Aerozil Ltd.) were mixed using a Henschel mixer, to give a toner of the present invention.

This toner was sliced using a microtome into ultrathin slices, and the resulting slices were observed by a transmission electron microscope. As a result, it was found that the resin particles in the order of about 0.3 μm were uniformly dispersed in the toner.

Comparative Example 1

| | |
|---|---|
| Polyester resin (1) | 100 parts |
| Carbon black ("MOGAL L" (manufactured by Cabot Corporation)) | 6 parts |
| Iron azo complex ("T-77," manufactured by Hodogaya Chemical Co., Ltd.) | 3 parts |
| Polypropylene wax ("VISCOL 660P" (manufactured by Sanyo Chemical Industries, Ltd.)) | 2 parts |

were used to carry out procedures similar to those of Example 1, to give a toner having an average particle size of 8.1 μm.

Comparative Example 2

| | |
|---|---|
| Polyester resin (1) | 100 parts |
| Carbon black ("MOGAL L" (manufactured by Cabot Corporation)) | 6 parts |
| Iron azo complex ("T-77," manufactured by Hodogaya Chemical Co., Ltd.) | 3 parts |
| Polypropylene wax ("VISCOL 660P" (manufactured by Sanyo Chemical Industries, Ltd.)) | 2 parts |
| Resin particles "b" | 3 parts |

were used to carry out procedures similar to those of Example 1, to give a toner having an average particle size of 8.3 μm.

Comparative Example 3

| | |
|---|---|
| Polyester resin (1) | 100 parts |
| Carbon black ("MOGAL L" (manufactured by Cabot Corporation)) | 6 parts |
| Iron azo complex ("T-77," manufactured by Hodogaya Chemical Co., Ltd.) | 3 parts |
| Polypropylene wax ("VISCOL 660P" (manufactured by Sanyo Chemical Industries, Ltd.)) | 2 parts |
| Rubbery block obtained in Comparative Production Example 1 | 3 parts |

were used in attempt to carry out procedures similar to those of Example 1. However, the rubbery material separated upon finely pulverizing the mixture. The average particle size of the toner after which the rubbery material separated were found to be 8.2 μm. This toner was sliced using a microtome into ultrathin slices, and the resulting slices were observed by a transmission electron microscope. As a result, it was found that substantially no resin particles were observed in the toner.

Comparative Example 4

| | |
|---|---|
| Polyester resin (2) (softening point: 135° C.) comprising as its main components terephthalic acid, n-dodecenylsuccinic acid, trimellitic acid, bisphenol A ethylene oxide adduct, and bisphenol A propylene oxide adduct | 100 parts |
| Carbon black ("MOGAL L" (manufactured by Cabot Corporation)) | 6 parts |
| Iron azo complex ("T-77," manufactured by Hodogaya Chemical Co., Ltd.) | 3 parts |
| Polypropylene wax ("VISCOL 660P" (manufactured by Sanyo Chemical Industries, Ltd.)) | 2 parts |

were used to carry out procedures similar to those of Example 1, to give a toner having an average particle size of 8.1 μm.

Example 2

| | |
|---|---|
| Polyester resin (1) | 100 parts |
| Carbon black ("MOGAL L" (manufactured by Cabot Corporation)) | 6 parts |
| Iron azo complex ("T-77," manufactured by Hodogaya Chemical Co., Ltd.) | 3 parts |
| Polypropylene wax ("VISCOL 660P" (manufactured by Sanyo Chemical Industries, Ltd.)) | 2 parts |
| Resin particles "c" | 3 parts |

were previously blended, and the mixture was melt-blended, pulverized by a jet mill, and classified, to give colored particles having an average particle size of 8.2 μm. To parts of the colored particles, 0.4 parts of "AEROZIL R-972" (manufactured by Nippon Aerozil Ltd.) were mixed using a Henschel mixer, to give a toner of the present invention.

This toner was sliced using a microtome into ultrathin slices, and the resulting slices were observed by a transmission electron microscope. As a result, it was found that the resin particles in the order of about 0.3 μm were uniformly dispersed in the toner.

Comparative Example 5

| | |
|---|---|
| Polyester resin (l) | 100 parts |
| Carbon black ("MOGAL L" (manufactured by Cabot Corporation)) | 6 parts |
| Iron azo complex ("T-77," manufactured by Hodogaya Chemical Co., Ltd.) | 3 parts |
| Polypropylene wax ("VISCOL 660P" (manufactured by Sanyo Chemical Industries, Ltd.)) | 2 parts |
| Resin particles "d" | 3 parts |

were used to carry out procedures similar to those of Example 2, to give a toner having an average particle size of 8.3 μm. However, white rubbery particles were formed upon pulverization. The resulting toner was sliced using a microtome into ultrathin slices, and the resulting slices were observed by a transmission electron microscope. As a result, it was found that substantially no resin particles were observed in the toner.

Example 3

| | |
|---|---|
| Polyester resin (1) | 100 parts |
| Carbon black ("MOGAL L" (manufactured by Cabot Corporation)) | 4 parts |
| Iron azo complex ("T-77," manufactured by Hodogaya Chemical Co., Ltd.) | 2 parts |
| Polypropylene wax ("NP-105," manufactured by Mitsui Petrochemical Industries, Ltd.) | 1 part |
| Resin particles "a" | 3 parts |

were previously blended, and the mixture was melt-blended, pulverized by a let mill, and classified, to give colored particles having an average particle size of 10.5 μm. To 100 parts of the colored particles, 0.3 parts of "AEROZIL R-972" (manufactured by Nippon Aerozil Ltd.) were mixed using a Henschel mixer, to give a toner of the present invention.

This toner was sliced using a microtome into ultrathin slices, and the resulting slices were observed by a transmission electron microscope. As a result, it was found that the resin particles in the order of about 0.3 μm were uniformly dispersed in the toner.

Comparative Example 6

| | |
|---|---|
| Polyester resin (1) | 100 parts |
| Carbon black ("MOGAL L" (manufactured by Cabot Corporation)) | 4 parts |
| Iron azo complex ("T-77," manufactured by Hodogaya Chemical Co., Ltd.) | 2 parts |
| Polypropylene wax ("NP-105," manufactured by Mitsui Petrochemical Industries, Ltd.) | 1 part |

were used to carry out procedures similar to those of Example 3, to give a toner having an average particle size of 10.5 μm.

Comparative Example 7

| | |
|---|---|
| Polyester resin (1) | 100 parts |
| Carbon black ("MOGAL L" (manufactured by Cabot Corporation)) | 4 parts |
| Iron azo complex ("T-77," manufactured by Hodogaya Chemical Co., Ltd.) | 2 parts |
| Polypropylene wax ("NP-105," manufactured by Mitsui Petrochemical Industries, Ltd.) | 1 part |
| Resin particles "b" | 3 parts |

were used to carry out procedures similar to those of Example 3, to give a toner having an average particle size of 10.4 μm.

Comparative Example 8

| | |
|---|---|
| Polyester resin (2) | 100 parts |
| Carbon black ("MOGAL L" (manufactured by Cabot Corporation)) | 4 parts |
| Iron azo complex ("T-77," manufactured by Hodogaya Chemical Co., Ltd.) | 2 parts |
| Polypropylene wax ("NP-105," manufactured by Mitsui Petrochemical Industries, Ltd.) | 1 part |

were used to carry out procedures similar to those of Example 3, to give a toner having an average particle size of 10.3 μm.

Evaluation Test 1

122.5 g of each of the toners of Examples 1, 2, and Comparative Examples 1 to 5 and 3377.5 g of a ferrite carrier coated with a silicone resin were blended in a V-type blender to prepare a developer. Using each of the developers, continuous printing tests were conducted using a copy machine "SD-2075" (manufactured by Sharp Corporation) (75 ppm) by setting the fixing temperature at 180° C. The fixing ratio was measured by changes in image densities before and after working the solid image portion with a rubbing testing machine equipped with a sand-containing rubber eraser.

TABLE 1

| Toner | Fixing Ratio (%) | Stability for Continuous Printing |
|---|---|---|
| Example 1 | 93.3 | No problems up until printing 600,000 sheets. |
| Example 2 | 93.3 | No problems up until printing 600,000 sheets. |
| Comparative Example 1 | 94.5 | Background generated at about 50,000 sheets. Printing test quitted. |
| Comparative Example 2 | 92.5 | Background generated at about 150,000 sheets. Printing test quitted. |
| Comparative Example 3 | 94.0 | Background generated at about 50,000 sheets. Printing test quitted. |
| Comparative Example 4 | 72.2 | No problems up until printing 600,000 sheets. |
| Comparative Example 5 | 93.7 | Background generated at about 70,0000 sheets. Printing test quitted. |

As is clear from above, the toners of the present invention were free from disadvantageous effects to the fixing temperature by the addition of the resin particles, and were fixable at a low temperature. In addition, as in the case of Comparative Example 4 where a resin having a high softening point was used, stable, continuous printing durability was achieved.

On the other hand, in the case of the toner of Comparative Example 1 where no resin particles of the present invention were added, its continuous printing durability was notably poor, though the fixing ability was good. When the toner of Comparative Example 1 was subjected to a particle size measurement after the printing test, the average particle size was 7.3 μm, indicating an increase in the percentage of the fine particle portions, and the toner was presumably broken. In addition, in the case where the resin particles showing no rubber elasticity at room temperature using monomers having a high Tg (glass transition temperature) (Comparative Example 2), although a slight effect can be obtained compared to those where no resin particles were added, breaking of the toners were found. Also, in the case where the resin particles which comprised a coating layer on the surface of the resin particles, none of the coating layers having a Tg of 50° C. or more, were used (Comparative Examples 3 and 5), the particles were aggregated in the toner and unable to be uniformly dispersed, so that the desired properties to be achieved in the present invention were not exhibited.

Evaluation Test 2

Using each of the toners of Example 3 and Comparative Examples 6 to 8, continuous printing tests were conducted by using a plain paper facsimile "TF-58HW" manufactured by Toshiba Corporation (employing the nonmagnetic one-component developing method similar to that shown in FIG. 1) by setting the fixing temperature to 160° C. The fixing ratio was measured by changes in image densities before and after working the solid image portion with a rubbing testing machine equipped with a sand-containing rubber eraser.

The results are shown in Table 2.

TABLE 2

| Toner | Fixing Ratio (%) | Stability for Continous Printing |
|---|---|---|
| Example 3 | 92.5 | No problems up until printing 10,000 sheets. |
| Compapative Example 6 | 89.5 | Background generated at about 1,000 sheets. Printing test quitted. |
| Comparative Example 7 | 90.0 | Background generated at about 3,000 sheets. Printing test quitted. |
| Comparative Example 8 | 72.2 | No problems up until printing 10,000 sheets. |

As is clear from above, the toner of the present invention were free from disadvantageous effects to the fixing temperature by the addition of the resin particles, and were fixable at a low temperature. In addition, as in the case of Comparative Example 8where a resin having a high softening point was used, stable, continuous printing durability was achieved.

On the other hand, in the case of the toner of Comparative Example 6 where no resin particles of the present invention were added, its continuous printing durability was notably poor, though the fixing ability was good. When the toner of Comparative Example 6 was subjected to a particle size measurement after the printing test, the average particle size was 8.3 μm, indicating an increase in the percentage of the fine particle portions, and the toner was presumably broken.

In addition, in the case where the resin particles showing no rubber elasticity at room temperature using monomers having a high Tg (glass transition temperature) (Comparative Example 7), although a slight effect can be obtained compared to those where no resin particles were added, breaking of the toners were found.

INDUSTRIAL APPLICABILITY

The resin particles usable in the present invention show good rubber elasticity at normal temperature conditions for using a toner. Therefore, when the resin particles in the present invention are added, the durability against shocking stress given by the carriers in the developer devices is improved in two-component toners, and the durability against sliding stress given by charging blades is improved in one-component nonmagnetic toners. Accordingly, in the present invention, low-molecular weight binder resins which were not usable in conventional toners may be employed, and as a result, the resulting toners of the present invention are fixable at a low temperature, and have excellent impact resistance and stability with the passage of time.

We claim:

1. A toner for electrophotography comprising a binder resin, a colorant, and a reinforcing agent, the toner being characterized in that said reinforcing agent is resin particles comprising a core layer coated with a vinyl polymer having a glass transition temperature of 50° C. or more, the core layer comprising an acrylic acid ester copolymer and/or a methacrylic acid ester copolymer having a glass transition temperature of 0° C. or less, or a diene copolymer having a glass transition temperature of 0° C. or less.

2. The toner for electrophotography according to claim 1, wherein the acrylic acid ester copolymer and/or the methacrylic acid ester copolymer is obtainable by using one or more monomers selected from the group consisting of ethyl acrylate, propyl acrylate, butyl acrylate, cyclohexyl acrylate, 2-ethylhexyl acrylate, octyl methacrylate, dodecyl methacrylate, and lauryl methacrylate.

3. The toner for electrophotography according to claim 1, wherein the diene copolymer is obtainable by using one or more monomers selected from the group consisting of 1,3-butadiene, isoprene, 2-chloro-1,3-butadiene, and 2-methyl-1,3-butadiene.

4. The toner for electrophotography according to any one of claims 1 to 3, wherein the core layer has inside the layer a core portion comprising a vinyl polymer.

5. The toner for electrophotography according to claim 4, wherein the vinyl polymer constituting the core portion is obtainable by using one or more monomers selected from the group consisting of styrene, vinyltoluene, α-methylstyrene, monochlorostyrene, 3,4-dichlorostyrene, and bromostyrene.

6. The toner for electrophotography according to claim 1, wherein the vinyl polymer having a glass transition temperature of 50° C. or more is obtainable by using one or more monomers selected from the group consisting of styrene, vinyltoluene, α-methylstyrene, monochlorostyrene, 3,4-dichlorostyrene, and bromostyrene.

7. The toner for electrophotography according to claim 4 , wherein the resin particles comprise 0 to 40% by weight of the core portion, 30 to 90% by weight of the core layer, and 10 to 40% by weight of the coating layer.

8. The toner for electrophotography according to any one of claims 1 to 3, wherein the resin particles comprise 60 to 95% by weight of the core layer and 5 to 40% by weight of the coating layer.

9. The toner for electrophotography according to any one of claims 1–3, wherein the resin particles have a particle size of from 0.01 to 2.0 μm.

10. The toner for electrophotography according to any one of claims 1–3, wherein the amount of the resin particles added in the toner is from 0.01 to 10% by weight.

11. The toner for electrophotography according to any one of claims 1–3, wherein the toner for electrophotography is a nonmagnetic one-component toner usable in a developer device comprising a developer roller and a blade, the blade serving to regulate a thickness of a toner layer formed on the developer roller and to supply electric charges to the toner.

12. A reinforcing agent for a toner which comprises resin particles comprising a core layer and a coating layer coated thereon comprising a vinyl polymer having a glass transition temperature of 50° C. or more, said core layer comprising an acrylic acid ester copolymer and/or a methacrylic acid ester copolymer having a glass transition temperature of 0° C. or less, or a diene copolymer having a glass transition temperature of 0° C. or less.

13. The reinforcing agent for a toner according to claim 12, wherein the acrylic acid ester copolymer and/or the methacrylic acid ester copolymer is obtainable by using one or more monomers selected from the group consisting of ethyl acrylate, propyl acrylate, butyl acrylate, cyclohexyl acrylate, 2-ethylhexyl acrylate, octyl methacrylate, dodecyl methacrylate, and lauryl methacrylate.

14. The reinforcing agent for a toner according to claim 12, wherein the diene copolymer is obtainable by using one or more monomers selected from the group consisting of 1,3-butadiene, isoprene, 2-chloro-1,3-butadiene, and 2-methyl-1,3-butadiene.

15. The reinforcing agent for a toner according to any one of claims 12 to 14, wherein the core layer has inside the layer a core portion comprising a vinyl polymer.

16. The reinforcing agent for a toner according to claim 15, wherein the vinyl polymer constituting the core portion is obtainable by using one or more monomers selected from the group consisting of styrene, vinyltoluene, α-methylstyrene, monochlorostyrene, 3,4-dichlorostyrene, and bromostyrene.

17. The reinforcing agent for a toner according to claim 12, wherein the vinyl polymer having a glass transition temperature of 50° C. or more is obtainable by using one or more monomers selected from the group consisting of styrene, vinyltoluene, α-methylstyrene, monochlorostyrene, 3,4-dichlorostyrene, and bromostyrene.

18. The reinforcing agent for a toner according to claim 15, wherein the resin particles comprise 0 to 40% by weight of the core portion, 30 to 90% by weight of the core layer, and 10 to 40% by weight of the coating layer.

19. The reinforcing agent for a toner according to any one of claims 12 to 14, wherein the resin particles comprise 60 to 95% by weight of the core layer and 5 to 40% by weight of the coating layer.

20. The reinforcing agent for a toner according to any one of claims 12 to 14, wherein the resin particles have a particle size of from 0.01 to 2.0 μm.

21. In a method for forming fixed images by utilizing a nonmagnetic one-component developing method employing a developer device comprising a developer roller and a blade, the blade serving to regulate a thickness of a toner layer formed on the developer roller and to supply electric charges to the toner, the method for forming fixed images being characterized by the use of the toner for electrophotography according to any one of claims 1, 2, 3 and 6.

22. The toner for electrophotography according to claim 5, wherein the resin particles comprise 0 to 40% weight of the core portion, 30 to 90% by weight of the core layer, and 10 to 40% by weight of the coating layer.

23. The reinforcing agent for a toner according to claim 16, wherein the resin particles comprise 0 to 40% by weight of the core portion, 30 to 90% by weight of the core layer, and 10 to 40% by weight of the coating layer.

24. The toner composition according to any one of claims 1 to 3, wherein the resin particles have a particle size of from 0.1 to 0.7 μm.

25. The toner composition according to any one of claims 1–3 wherein the resin particles have a particle size of from 0.2 to 0.5 μm.

26. A toner for electrophotography comprising a binder resin, a colorant, and a reinforcing agent, the toner being characterized in that said reinforcing agent comprises resin particles wherein said resin particles comprise a core layer coated with a vinyl polymer, the core layer comprising an acrylic acid ester copolymer and/or a methacrylic acid ester copolymer, or a diene copolymer, wherein said core layer has a glass transition temperature which is less than the glass transition temperature of the coat layer by at least 50° C.

27. In a method for forming fixed images by utilizing a nonmagnetic one-component developing method employing a developer device comprising a developer roller and a blade, the blade serving to regulate a thickness of a toner layer formed on the developer roller and to supply electric charges to the toner, the method for forming fixed images being characterized by the use of the toner for electrophotography according to claim 5.

28. In a method for forming fixed images by utilizing a nonmagnetic one-component developing method employing a developer device comprising a developer roller and a blade, the blade serving to regulate a thickness of a toner layer formed on the developer roller and to supply electric charges to the toner, the method for forming fixed images being characterized by the use of the toner for electrophotography according to claim 7.

* * * * *